US005429095A

United States Patent [19]

Aodai et al.

[11] Patent Number: 5,429,095

[45] Date of Patent: Jul. 4, 1995

[54] APPARATUS FOR SUPPLYING FUEL TO AN ENGINE THROUGH A DIAPHRAGM-TYPE CARBURETOR

[75] Inventors: Tokihiko Aodai; Kiyoharu Kohara, both of Toyota, Japan

[73] Assignee: TK Carburetor Co., Ltd., Japan

[21] Appl. No.: 153,319

[22] Filed: Nov. 16, 1993

[30] Foreign Application Priority Data

Dec. 2, 1992 [JP] Japan ..... 4-350467

[51] Int. Cl.[6] ..... F02M 37/04; E03B 5/00

[52] U.S. Cl. ..... 123/514; 123/506; 137/565

[58] Field of Search ..... 123/509, 514, 506, 73 C, 123/73 AD; 137/565, 569

[56] References Cited

U.S. PATENT DOCUMENTS

| | | | |
|---|---|---|---|
| 3,476,145 | 11/1969 | Thompson | 137/565 |
| 4,271,093 | 6/1981 | Kobayashi . | |
| 4,509,491 | 4/1985 | Kawatei | 123/506 |
| 4,519,349 | 5/1985 | Cheney | 123/514 |
| 4,527,580 | 7/1985 | Chheda | 137/565 |
| 4,732,191 | 3/1988 | Visser | 137/565 |
| 4,976,246 | 11/1990 | Schierling | 123/509 |
| 5,148,792 | 9/1992 | Tuckey | 123/569 |
| 5,241,931 | 9/1993 | Radel | 123/514 |
| 5,259,352 | 11/1993 | Gerhardy | 123/509 |

FOREIGN PATENT DOCUMENTS

| | | |
|---|---|---|
| 51-43315 | 10/1976 | Japan . |
| 55-69748 | 5/1980 | Japan . |

*Primary Examiner*—Carl S. Miller

*Attorney, Agent, or Firm*—Palmatier, Sjoquist & Helget

[57] ABSTRACT

An apparatus for supplying fuel in a fuel tank to an engine through a diaphragm type carburetor includes a fuel pump and an exhaust passage. The fuel pump includes a suction valve and a discharge valve and is driven by pulsation pressure caused by rotation of an engine. The fuel pump has a discharge port connected with a fuel inlet of the carburetor. At least one of the suction valve and the discharge valve of the fuel pump is so located as to be immersed in fuel of the same level as that of the fuel tank. The exhaust passage has one end communicating with a position between the fuel inlet of the carburetor and a diaphragm chamber and the other end communicating with the fuel tank.

5 Claims, 3 Drawing Sheets

APPARATUS FOR SUPPLYING FUEL TO AN ENGINE THROUGH A DIAPHRAGM-TYPE CARBURETOR

BACKGROUND OF THE INVENTION

1. Field of the Invention

The present invention relates to an apparatus for supplying fuel in a fuel tank to an engine through a diaphragm-type carburetor.

2. Description of the Prior Art

An engine used, for example, in an engine-driven mowing machine is unstable in its attitude during operation. This results in an unstable attitude of a carburetor used to supply fuel to such an engine. In order to achieve stable fuel supply independent of the attitude of the carburetor, a diaphragm chamber has generally been provided in the carburetor. The diaphragm chamber includes a diaphragm through which the diaphragm chamber is in contact with the atmospheric pressure, a fuel inlet in which a fuel valve is provided, and a fuel outlet which communicates with an intake pipe of the engine through a nozzle. When the intake pressure of the engine is reduced, the diaphragm is deflected to open the fuel valve, permitting fuel introduction into the diaphragm chamber. When such introduction of fuel into the diaphragm chamber increases the pressure therein to a predetermined level, deflection of the diaphragm is relieved, so that the fuel valve is closed. Repetition of this operation permits the diaphragm chamber to normally store therein fuel of a constant volume at a constant pressure. This assures stable fuel supply independent of the attitude of the carburetor.

In order to supply fuel to the diaphragm chamber, a fuel pump is generally employed which is driven by pulsation pressure caused by rotation of the engine.

In general, when an engine with a diaphragm-type carburetor has been kept out of use for a long time, the diaphragm chamber and a pipe connecting between the diaphragm chamber and the fuel tank become empty.

Once the diaphragm chamber and the pipe between the diaphragm chamber and the fuel tank have become empty, it takes a rather long time after starting of the fuel pump to refill the diaphragm chamber with fuel, resulting in substantial deterioration of startability of the engine. This is considered to be caused by the following factors:

(1) Once the fuel pump for supplying fuel to the diaphragm chamber has become empty, sealing performance of a suction valve and a discharge valve in the fuel pump is reduced, so that it takes a rather long time to restart fuel supply.

(2) If the diaphragm chamber is filled with air, it takes a long time to expel the air out of the diaphragm chamber.

(3) Introduction of air within the pipe connecting between the diaphragm chamber and the fuel pump into the diaphragm chamber increases the effect of the factor as described in the above paragraph (2).

In order to solve the problem, several techniques have been developed. For example, Japanese Laid-Open Utility Model Publication No. 51-43315 discloses a technique in which a manual pump is provided in a pipe connecting between the fuel tank and the carburetor, the manual pump being operated before starting of the engine to supply fuel to the carburetor, with a tickler lever operated at the same time to open a fuel valve in the inlet of the diaphragm chamber and an overflow valve. Japanese Laid-Open Patent Publication No. 55-69748 or U.S. Pat. No. 4,271,093 discloses another technique in which the diaphragm chamber may be connected with a manual suction pump, which is operated before starting of the engine to suck fuel within the fuel tank into the diaphragm chamber.

In the former prior art technique, both of the manual pump and the tickler lever must be operated before starting of the engine, and consequently both hands of a user are engaged for them, resulting in cumbersome handling.

In the latter prior art technique, the manual pump must be also operated before starting, requiring in cumbersome handling.

SUMMARY OF THE INVENTION

It is an object of the present invention to provide an apparatus for supplying fuel to the engine which can be started without requiring specific starting operation and only by cranking of the engine by a recoil starter or a self-starting motor and which is simple in construction.

According to the present invention, there is provided a fuel supply apparatus comprising a fuel tank, a diaphragm type carburetor, a fuel pump including a suction valve and a discharge valve, and an exhaust passage. The fuel pump is driven by pulsation pressure caused by rotation of an engine and has a discharge port connected with a fuel inlet of the carburetor. At least one of the suction valve and the discharge valve of the fuel pump is so located as to be immersed in fuel of the same level as that of the fuel tank. The exhaust passage has one end communicating with a position between the fuel inlet of the carburetor and a diaphragm chamber and the other end communicating with the fuel tank.

In the above apparatus, as at least one of the suction valve and the discharge valve of the fuel pump is immersed in the fuel in the fuel tank or in fuel of the same level as that of the fuel tank, improved valve function is obtainable.

When the fuel pump is driven through cranking (forced rotation) of the engine, fuel is quickly discharged and begins to be supplied to the carburetor.

Further, as most of air in a pipe connecting between the fuel pump and the carburetor is pushed out of the exhaust passage into the fuel tank by the discharged fuel, the amount of air introduced into the diaphragm is remarkably reduced. Consequently, fuel can rapidly reach the diaphragm chamber of the carburetor.

Furthermore, cranking of the engine causes intake vacuum to act on the diaphragm chamber through a nozzle, so that the diaphragm chamber is sucked to open the fuel valve. Thus, the fuel is introduced into the diaphragm chamber by the discharge pressure of the fuel pump as well as the intake vacuum to be supplied to the engine through subsequent recoil operation.

The present invention will be more fully understood from the following detailed description and appended claims when taken with the accompanied drawings.

DETAILED DESCRIPTION OF THE PREFERRED EMBODIMENTS

Figure 1:
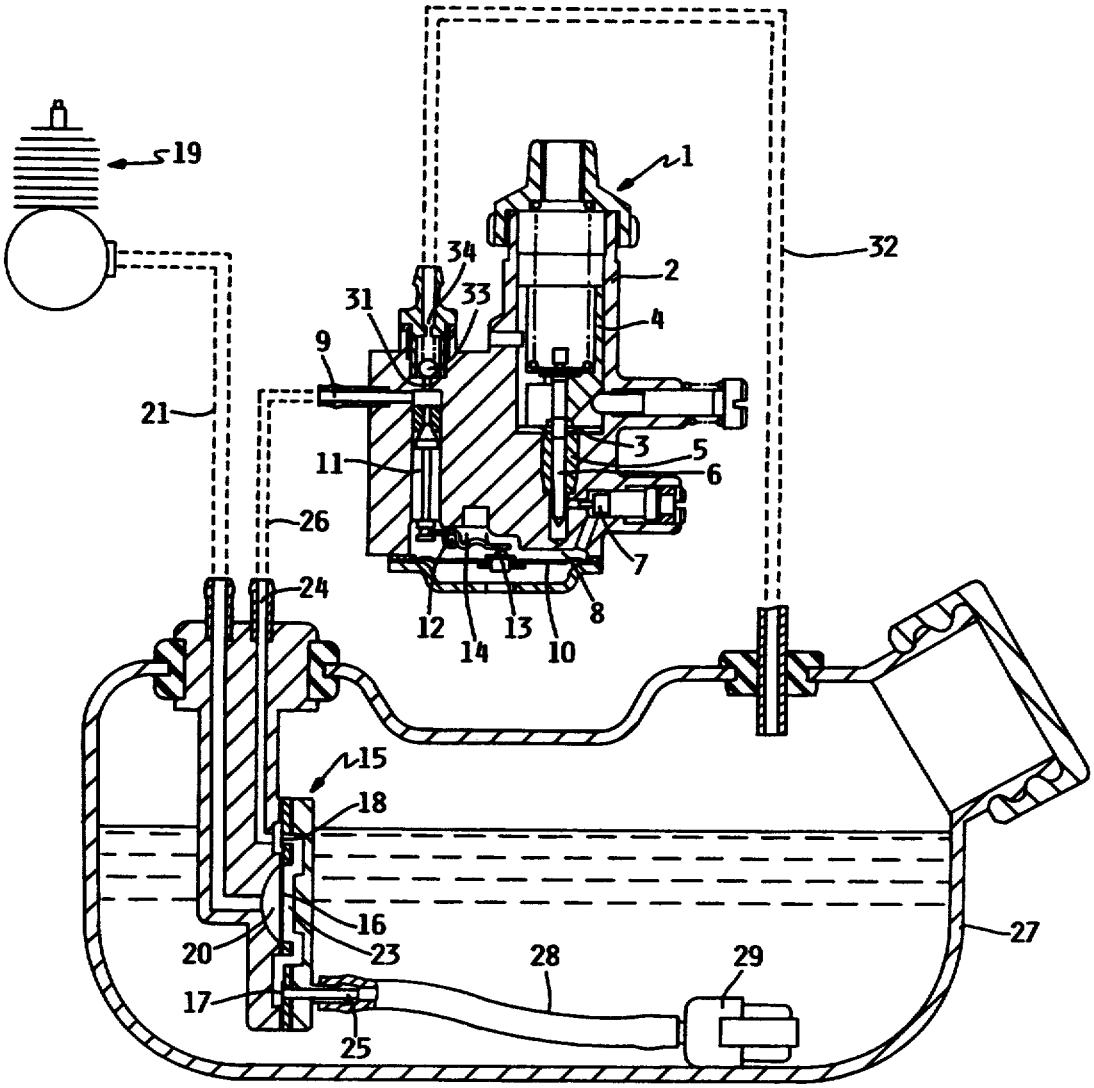
FIG. 1 is a vertical sectional view of a first embodiment of the present invention.

Referring now to FIG. 1, shown therein is a diaphragm type carburetor i according to a first embodiment of the present invention. The diaphragm type carburetor 1 comprises a carburetor body 2 having an intake passage 3 formed therethrough. The intake passage 3 has an upstream opening connected with an air cleaner (not shown) and a downstream opening connected with an intake port of an engine 19. A flow metering valve 4 is retractably urged from upward within the intake passage 3. The intake passage 3 has a main nozzle 5 opening in the bottom wall thereof below the flow metering valve 4. The flow metering valve 4 has a jet needle 6 extending downwardly therefrom and inserted into the main nozzle 5. The main nozzle 5 communicates with a diaphragm chamber 8 through a fuel flow control jet 7.

The diaphragm chamber 8 has a fuel inlet 9 in which is provided a fuel valve 11 operable to open and close the inlet 9 in association with the diaphragm 10. A lever 13 is provided between the fuel valve 11 and the diaphragm 10 and is supported at the center thereof by a support pin 12. The lever 13 has one end attached to the fuel valve 11 and the other end connected with the diaphragm 10.

Thus, when a great suction vacuum acts on the diaphragm chamber 8 through the main nozzle 5, the diaphragm 10 is deflected toward the diaphragm chamber 8 to push up the right end of the lever 13 as shown in FIG. 1, causing the fuel valve 11 to be lowered and kept in its open position.

When fuel has been introduced into the diaphragm chamber 8 enough to relieve the strong vacuum in the diaphragm chamber 8, the fuel valve 11 is moved to its closed position by the urging force of a spring 14 which is in engagement with the lever 13 so as to prevent further introduction of fuel into the diaphragm chamber 8.

The apparatus further comprises a fuel pump 15 which may be a diaphragm type pump well known to the art and composed of a pump diaphragm 16, a suction valve 17 and a discharge valve 18. The diaphragm 16 defines on one side thereof a pressure chamber 20 to which is applied operating pulsation pressure of the engine, for example, pulsation pressure in a crank chamber of the two-cycle engine 19 through a pipe 21 so as to vibrate the pump diaphragm 16, suck fuel through a suction port 25 and the suction valve 17 into a pump chamber 23 defined by the diaphragm 16 on the other side thereof, and then send the fuel through the discharge valve 18, a discharge port 24 and a pipe 26 to the fuel inlet 9 of the carburetor.

Figure 2:
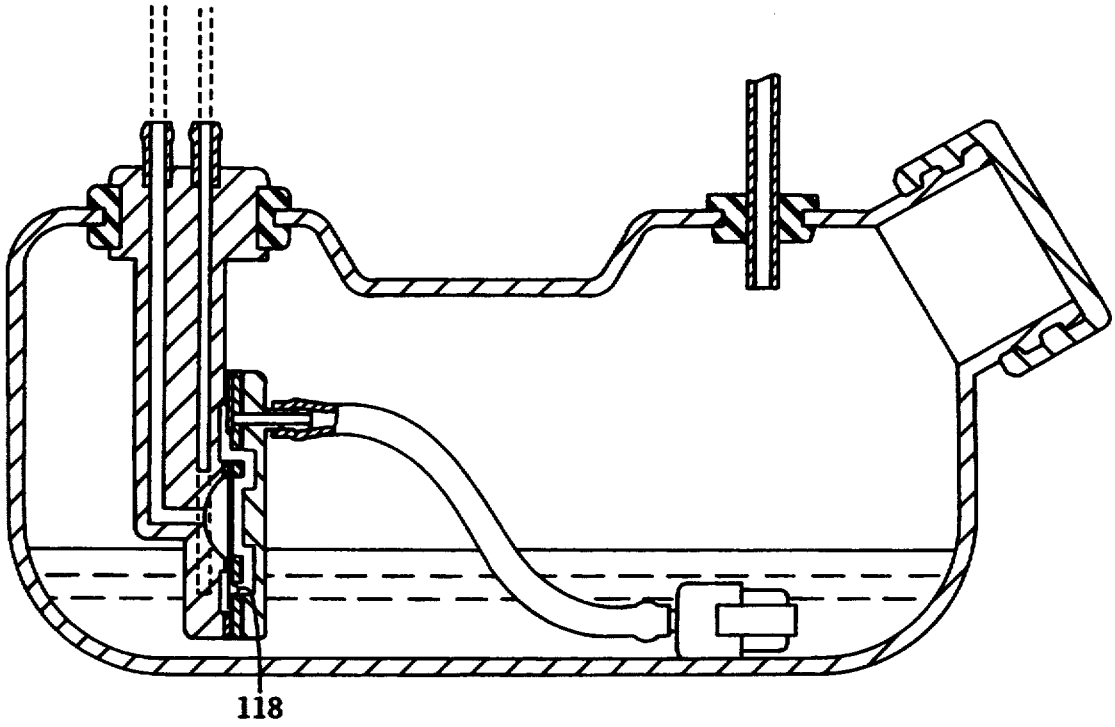
FIG. 2 is a vertical sectional view illustrating a modified arrangement of a discharge valve.

The fuel pump 15 may be arranged within a fuel tank 27 or on the side or bottom thereof at such a location that at least one of the suction valve 17 and the discharge valve 18 can be immersed under the fuel level of the fuel tank 27 when the engine is in a starting attitude. In the apparatus as shown in FIG. 1, even when there is little fuel left in the fuel tank, at least the suction valve 17 is immersed in the fuel. FIG. 2 shows another arrangement in which at least a discharge valve 118 is immersed in the fuel. The fuel pump may be positioned outside of the fuel tank, in which case, at least one of the suction valve and the discharge valve is to be immersed in the fuel through a pipe connecting between the suction valve and the fuel tank. In FIG. 1, the suction port 25 of the fuel pump is connected through a pipe 28 with a filter 29 which is movable due to its dead weight along the inclination of the tank 27 to the lowermost position thereof.

An exhaust passage 31 is provided, having one end communicating with a position between the fuel inlet 9 of the carburetor 1 and the fuel valve 11 or the diaphragm chamber 8. The other end of the exhaust passage 31 is connected through a pipe 32 with the fuel tank 27. The exhaust passage 31 is provided with a check valve 33 which normally closes the exhaust passage 31 and opens it under the discharge pressure of the fuel pump 15 and a restrictor 34. The check valve 33 is effective to prevent introduction of air from the exhaust passage 31 and consequent flow of fuel within the pipe 26 back to the fuel tank 27 after the engine is stopped. The restrictor 34 is effective to restrict the amount of fuel flowing back through the exhaust passage 31 to the fuel tank 27 during high speed running of the engine so as to prevent shortage of fuel supply to the engine. Both of the check valve 33 and the restrictor 34 are not necessarily required, but either one may be provided for this purpose.

The apparatus of the above construction operates as follows. When the engine is cranked by a recoil starter or a self-starting motor to start the engine, working pressure generated in a crank chamber is applied to the pressure chamber of the fuel pump to activate the fuel pump 15.

As at least one of the suction valve 17 and the discharge valve 18 of the fuel pump 15 is immersed in the fuel, the valve portion is constantly filled with fuel, so that, when the pump 15 is activated, fuel can be quickly supplied to the carburetor. The air in the pipe 26 is pushed by the fuel discharged from the fuel pump 15, with a part of the air being sucked into the diaphragm chamber 8 but most of the air being quickly exhausted through the exhaust passage 31 to the fuel tank 27, permitting fuel to instantaneously reach the carburetor. The air introduced into the diaphragm chamber 8 is so little that the intake vacuum of the engine can rapidly suck out the air in the diaphragm chamber 8 through the intake passage 3.

When the engine is cranked, the intake vacuum is applied to the diaphragm chamber 8 through the main nozzle 5 to open the fuel valve 11, so that the fuel discharged from the fuel pump 15 quickly flows into the diaphragm chamber 8 and begins to be sucked into the engine through the main nozzle 5. This assures improved startability of the engine.

While the engine is running, flow of fuel through the exhaust passage 31 to the fuel tank 27 is restricted by the resistance of the check valve 33 or the restrictor 34, assuring supply of sufficient amount of fuel to the carburetor 1.

Figure 3:
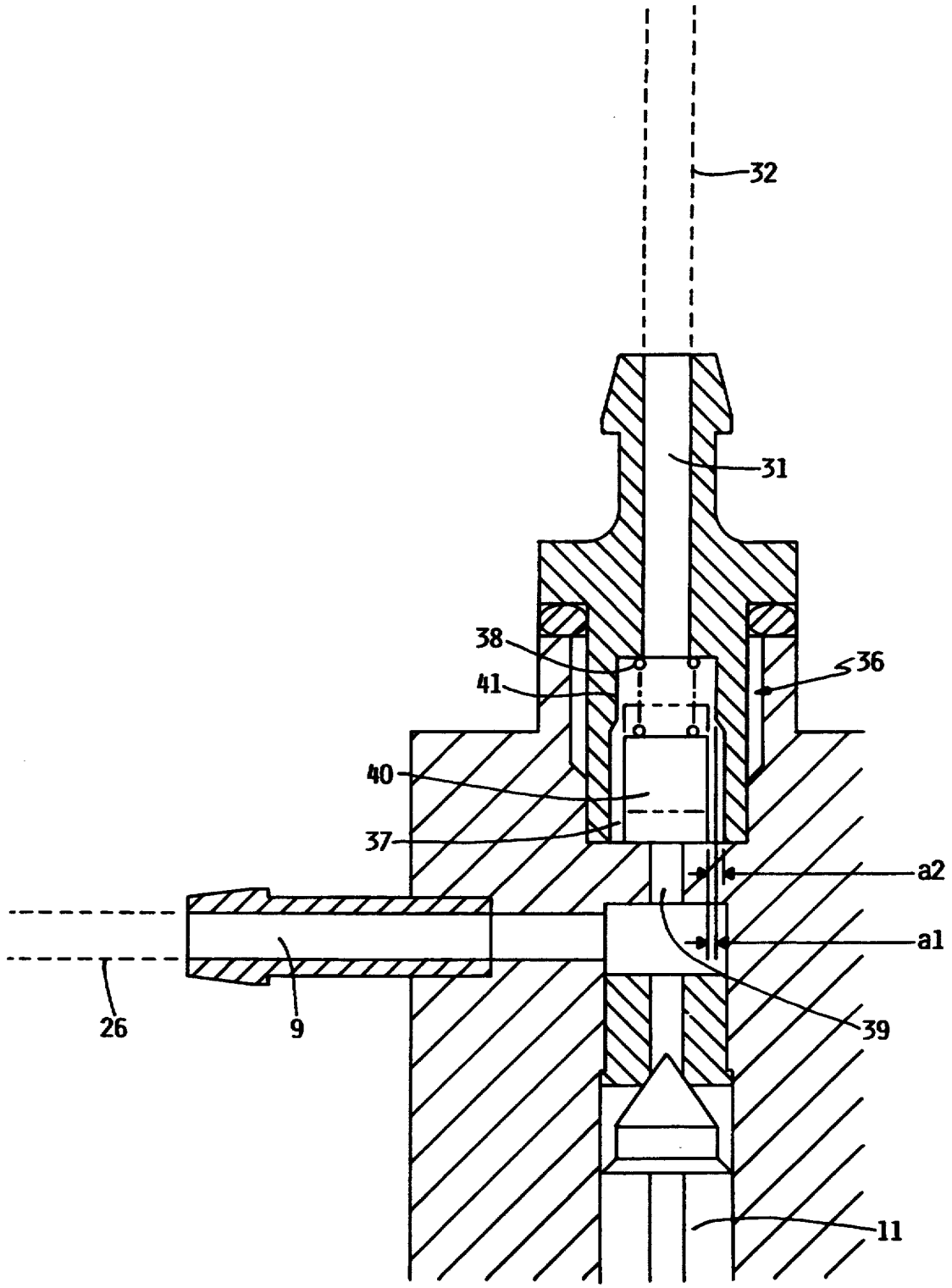
FIG. 3 is a vertical sectional view of another embodiment of the present invention.

FIG. 3 shows another embodiment of the present invention, in which a flow control valve 36 is provided in the exhaust passage 31 and is adapted to normally close the passage 31 and open it under the discharge pressure of the fuel pump 15, and further reduce the flow area of the exhaust passage 31 when the discharge pressure exceeds a predetermined value.

The flow control valve 36 comprises a valve chamber 37 provided in the middle of the exhaust passage 31, a valve body 40 received in the valve chamber 37 and normally closing a valve chamber inlet 39 due to its dead weight or under the urging force of a spring 38 and opening the inlet 39 under the discharge pressure of the fuel pump 15, and a restrictor 41 provided in the upper portion of the valve chamber 37 and adapted to reduce the clearance defined between the valve body 40 and the valve chamber 37 when fuel flow through the exhaust passage is so increased as to move the valve body 40 toward the upper portion of the valve chamber 37. Thus, when the discharge pressure of the fuel pump 15 exceeds a predetermined value, the valve body 40 is inserted into the restrictor 41 to reduce the flow area in the valve chamber 37 and consequently decrease flow of fuel therethrough. The exhaust passage 31 may be so designed as to be fully closed when the valve body 40 is substantially lifted.

Immediately after the engine is stopped, the fuel pressure in the pipe 26 is kept so high as to move the valve body 40 to the upper portion of the valve chamber 37, leaving the valve chamber inlet 39 open, but, as the residual pressure is expelled through the clearance defined between the restrictor 41 of the valve chamber and the valve body 40, the valve body 40 returns to the position where it closes the valve chamber inlet 39.

Thus, the flow control valve 36 controls the fuel flow through the clearance defined between the valve chamber 37 and the valve body 40, and when the valve body 40 is in the restrictor 41, any contamination blocking the clearance a1 defined between the valve body 40 and the restrictor 41 will be released in a wider clearance a2 defined between the valve body 40 and the valve chamber 37 when the valve body 40 is moved out of the restrictor 40, assuring constantly stable flow control.

Though, in the above mentioned embodiments, the fuel pump 15 is disposed in the fuel tank 27, it should be noted that the fuel pump 15 may be located outside the fuel tank 27, so long as at least one of the suction valve 17 and the discharge valve 18 of the fuel pump 15 is immersed under the fuel level of the fuel tank 27.

As described above, in the apparatus according to the present invention, the fuel pump activated by the pulsation pressure of the engine is installed, so that at least one of the suction valve and the discharge valve may be immersed in the fuel in the fuel tank, when the engine is in its starting attitude, and the discharge port of the fuel pump is connected with the fuel inlet of the carburetor. The exhaust passage extends from between the fuel inlet of the carburetor and the fuel valve of the diaphragm chamber and is connected at the other end thereof with the fuel tank, so that, only by recoil operation, the diaphragm chamber of the carburetor can be immediately filled with fuel and fuel supply to the engine is started. This assures improved startability of the engine as well as stable and continuous running thereof after started.

Furthermore, as the apparatus can eliminate provision of a priming pump which has been generally used in the prior art, the cost of the engine can be reduced.

While the invention has been described with reference to preferred embodiments thereof, it is to be understood that modifications or variations may be easily made without departing from the scope of the present invention which is defined by the appended claims.

What is claimed is:

1. An apparatus for supplying fuel in a fuel tank to an engine through a diaphragm type carburetor, comprising a fuel pump including a suction valve and a discharge valve and driven by pulsation pressure caused by rotation of the engine, said fuel pump having a discharge port connected with a fuel inlet of the carburetor, the fuel pump being in flow communication with fuel in the fuel tank such that at least one of the suction valve and the discharge valve of the fuel pump are positioned lower than the fuel in the fuel tank, an exhaust passage having one end communicating with a position between the fuel inlet of the carburetor and a carburetor diaphragm chamber and having a second end, a flow control valve having an inlet connected to said second end and having an outlet connected to said fuel tank, said flow control valve comprising a valve chamber having an enlarged portion proximate the inlet and a restricted portion proximate the outlet, and a valve body movable within said valve chamber, whereby the valve body is movable by low fuel pump discharge pressure to provide a flow path through the enlarged portion and is movable by higher fuel pump discharge pressure to provide a restricted flow path through the restricted portion.

2. The apparatus as defined in claim 1, wherein said fuel pump is disposed in the fuel tank.

3. The apparatus as defined in claim 1, wherein said fuel pump is a diaphragm type pump.

4. The apparatus as defined in claim 3, wherein the diaphragm type pump has a pressure chamber communicating with a crank chamber of the engine.

5. The apparatus as defined in claim 1, wherein said valve body further comprises means for blocking said flow control valve outlet, whereby said valve body is movable by increased fuel pump discharge pressure into blocking relation to said outlet.

* * * * *